US010982584B2

(12) United States Patent
Weustenfeld et al.

(10) Patent No.: US 10,982,584 B2
(45) Date of Patent: Apr. 20, 2021

(54) METHOD FOR OPERATING A DRIVE DEVICE OF A MOTOR VEHICLE, AND CORRESPONDING DRIVE DEVICE

(71) Applicant: AUDI AG, Ingolstadt (DE)

(72) Inventors: Thomas Weustenfeld, Briarwood, NY (US); Thomas Lichius, Gaimersheim (DE); Johannes Weis, Ingolstadt (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 16/482,682

(22) PCT Filed: Jul. 18, 2018

(86) PCT No.: PCT/EP2018/069465

§ 371 (c)(1),
(2) Date: Jul. 31, 2019

(87) PCT Pub. No.: WO2019/029959

PCT Pub. Date: Feb. 14, 2019

(65) Prior Publication Data

US 2020/0277887 A1 Sep. 3, 2020

(30) Foreign Application Priority Data

Aug. 8, 2017 (DE) ..... 10 2017 213 777.0

(51) Int. Cl.
*F01P 7/14* (2006.01)
*F01P 3/18* (2006.01)

(52) U.S. Cl.
CPC ..... *F01P 7/14* (2013.01); *F01P 3/18* (2013.01); *F01P 2003/182* (2013.01);

(Continued)

(58) Field of Classification Search
CPC ..... F01P 7/14; F01P 3/18; F01P 2003/182; F01P 2003/185; F01P 2007/146; F01P 2025/08

See application file for complete search history.

(56) References Cited

U.S. PATENT DOCUMENTS

2005/0061263 A1* 3/2005 Lee ..... F01P 7/167 123/41.1
2010/0012054 A1* 1/2010 Justin ..... F01P 7/165 123/41.1

(Continued)

FOREIGN PATENT DOCUMENTS

DE 41 04 093 A1 8/1992
DE 100 55 452 A1 5/2001

(Continued)

*Primary Examiner* — Jacob M Amick
(74) *Attorney, Agent, or Firm* — Seed Intellectual Property Law Group LLP

(57) ABSTRACT

The disclosure relates to a method for operating a drive device of a motor vehicle, wherein the drive device has at least one heat-generating device and a cooling circuit for cooling the heat-generating device, and at least one first coolant cooler of the cooling circuit and at least one second coolant cooler of the cooling circuit are fluidically connected to the heat-generating device. It is thereby provided that the first coolant cooler and the second coolant cooler are fluidically connected in parallel to the heat-generating device, and that coolant arriving from the heat-generating device be divided by means of a control mechanism between the first coolant cooler and the second coolant cooler. The disclosure furthermore relates to a drive device of a motor vehicle.

19 Claims, 1 Drawing Sheet

Figure 1:
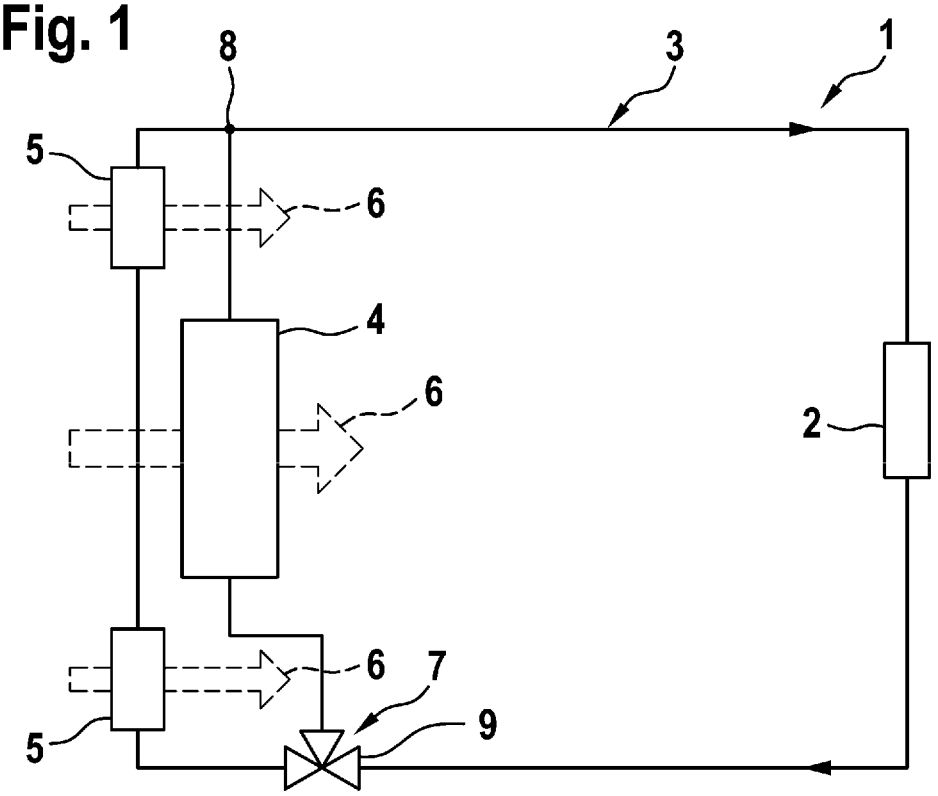

(52) U.S. Cl.
CPC ... *F01P 2003/185* (2013.01); *F01P 2007/146* (2013.01); *F01P 2025/08* (2013.01)

(56) References Cited

U.S. PATENT DOCUMENTS

| | | | | |
|---|---|---|---|---|
| 2014/0202660 | A1 | 7/2014 | Seligman | |
| 2017/0211460 | A1* | 7/2017 | Suzuki | F01P 7/14 |
| 2017/0321597 | A1* | 11/2017 | Michikawauchi | F01P 11/00 |

FOREIGN PATENT DOCUMENTS

| | | | |
|---|---|---|---|
| DE | 101 54 595 | A1 | 5/2002 |
| DE | 103 14 065 | A1 | 10/2004 |
| DE | 10 2004 050 436 | A1 | 4/2006 |
| DE | 10 2007 062 591 | A1 | 7/2009 |
| DE | 10 2010 001 752 | A1 | 8/2011 |
| DE | 10 2012 020 648 | A1 | 4/2014 |
| DE | 10 2012 217 229 | A1 | 6/2014 |
| DE | 10 2014 015 638 | A1 | 4/2016 |
| EP | 2 631 447 | A1 | 8/2013 |
| JP | 61-237820 | A | 10/1986 |
| JP | 6-81648 | A | 3/1994 |
| JP | 2006-291744 | A | 10/2006 |
| JP | 2006-316747 | A | 11/2006 |
| JP | 2013-086717 | A | 5/2013 |
| JP | 2015-175296 | A | 10/2015 |
| JP | 2016-151235 | A | 8/2016 |
| WO | 02/48516 | A1 | 6/2002 |

* cited by examiner

METHOD FOR OPERATING A DRIVE DEVICE OF A MOTOR VEHICLE, AND CORRESPONDING DRIVE DEVICE

The invention relates to a method for operating a drive device of a motor vehicle, wherein the drive device has at least one heat-generating device and a cooling circuit for cooling the heat-generating device, and at least one first coolant cooler of the cooling circuit and at least one second coolant cooler of the cooling circuit are fluidically connected in parallel to the heat-generating device, wherein coolant arriving from the heat-generating device is divided by means of a final control element between the first coolant cooler and the second coolant cooler. The invention furthermore relates to a drive device of a motor vehicle.

The drive device serves to provide a driving torque for the motor vehicle, in other words in this respect a torque which is aimed at driving the motor vehicle. The drive device has at least one drive unit, which may in principle be of any desired design. For example, the drive unit is present in the form of an internal combustion engine or an electric motor. Of course, the drive device may also be realized as a hybrid drive device and in such a case have a plurality of drive units which are preferably of different types. For example, a first instance of the drive units is realized as an internal combustion engine and a second instance of the drive units is realized as an electric motor. In the case of the hybrid drive device, the drive torque is preferably jointly provided at least from time to time by a plurality of the drive units.

During operation of the drive device, heat accumulates, namely in the heat-generating device. The drive unit is the heat-generating device, for example. However, other elements of the drive device may also generate heat and in this respect be present as heat-generating devices. In order to keep the temperature of the heat-generating device within a permissible operating temperature range, the cooling circuit is associated with it so as to be able to transfer heat. A coolant is circulated at least from time to time in the cooling circuit, said coolant being supplied to the heat-generating device or a heat exchanger connected to the heat-generating device in a heat-transferring manner. Heat is hereby transferred from the heat-generating device to the coolant, so that the temperature of the coolant rises.

The first coolant cooler and the second coolant cooler are provided in order to cool the coolant again, in particular in order to supply it again to the heat-generating device or the heat exchanger. These are fluidically connected to the heat-generating device so that the coolant flows through at least one of the coolant coolers before or after it is supplied to the heat-generating device. However, it may of course also be provided that no coolant is supplied to any of the coolant coolers, at least from time to time, for example in a warm-up operation of the drive device during which the drive device or the heat-generating device has a temperature which is below the operating temperature range. During the warm-up operation, the temperature is to be increased such that it subsequently lies within the operating temperature range.

The publication DE 10 101 54 595 A1, for example, is known from the prior art. This describes a device comprising a main loop for cooling a fuel cell and a secondary loop for cooling at least one motor. These two loops form part of the same circuit through which a single cooling fluid is passed, said circuit having a shared section of the two loops, and in which a shared pump is arranged. Furthermore, at least one regulating valve is provided which can distribute the cooling fluid between the loops according to a selected rule.

Furthermore, the publication US 2014/0202660 A describes a cooling system with a primary radiator having a first tank and a second tank. These tanks may include openings that are designed to connect the primary radiator to one or more supplemental radiators such that coolant may flow simultaneously through these radiators so that the cooling capacity of a motor vehicle is increased. The flow of coolant between the primary radiator and supplemental radiators may be adjusted either automatically or manually by means of control valves.

It is the object of the invention to propose a method for operating a drive device of a motor vehicle which has advantages relative to known methods, in particular a particularly efficient cooling of the heat-generating device.

This is achieved according to the invention by a method for operating a drive device having the features of claim 1. It is thereby provided that the coolant be divided between the first coolant cooler and the second coolant cooler as a function of a driving speed and/or of a blower control and/or of a cooling air mass flow and/or of a coolant volumetric flow of the motor vehicle.

The two coolant coolers, i.e. the first coolant cooler and the second coolant cooler, are arranged fluidically parallel to each other, and both are connected to the heat-generating device. The final control element is associated with the coolant coolers. It serves to divide the coolant arriving from the heat-generating device between the two coolant coolers. Depending on a setting of the final control element, a defined first portion of the coolant is in this respect supplied to the first coolant cooler and a defined second portion is supplied to the second coolant cooler. Here the two portions may be of any size and may also be equal to zero, so that no coolant is supplied to the corresponding coolant cooler.

In total, no more than the entirety of the coolant arriving from the heat-generating device is supplied to the two coolant coolers. The two portions may, however, also in total be less than 100% of the coolant arriving from the heat-generating device, so that only part of the coolant or no coolant at all is supplied to the coolant cooler. However, it is particularly preferred that the entirety of the coolant is divided between the two coolant coolers by means of the final control element, so that the sum of the two portions comes to 100%.

The final control element may be arranged as desired with respect to the two coolant coolers. For example, the final control element is disposed upstream or downstream of the coolant cooler with regard to a flow direction of the coolant. For example, coolant arriving from the direction of the heat-generating device is in this respect supplied via the final control element to the first coolant cooler, the second coolant cooler, or to both. Conversely, it may of course also be provided that coolant exiting the coolant coolers flows via the final control element in the direction of the heat-generating device. It is preferably provided that the final control element divides the coolant between the two coolant coolers in such a way that these have a greatest possible cooling effect on the coolant; the temperature of the coolant downstream of the coolant coolers, in other wordsthus has a lowest possible temperature. In this way, the cooling of the heat-generating device may be performed particularly effectively and efficiently.

A further embodiment of the invention provides that the coolant be cooled by the first coolant cooler with a first cooling capacity and by the second coolant cooler with a second cooling capacity. During the flow through the first coolant cooler, the coolant is in this respect cooled with the first cooling capacity, and during the flow through the second coolant cooler is cooled with the second cooling capacity, so that its temperature is correspondingly reduced. The first portion and the second portion of the coolant usually have the same temperature upstream of the coolant coolers.

Downstream of the coolant cooler and before the two portions of the coolant are reunited, the temperature of the first portion depends on the first cooling capacity and the temperature of the second portion depends on the second cooling capacity. If the cooling capacities are identical, the temperatures of the two portions will also be identical or at least approximately identical. If the cooling capacities differ from each another, for example as a result of different embodiments of the coolant coolers, different temperatures of the two portions of the coolant can also occur.

The first coolant cooler is particularly preferably designed as a main cooler, and the second coolant cooler is designed as an auxiliary cooler which has a lower cooling capacity. Accordingly, the second cooling capacity is less than the first cooling capacity. This is particularly the case if a number of second coolant coolers is greater than a number of first coolant coolers. Precisely one first coolant cooler but a plurality of second coolant coolers are particularly preferably realized. In this instance, the plurality of second coolant coolers preferably have at most the same cooling capacity in total as the first coolant cooler.

Within the scope of a further preferred embodiment of the invention, it may be provided that the coolant be divided between the first coolant cooler and the second coolant cooler such that a total cooling capacity resulting from the first cooling capacity and the second cooling capacity is at a maximum. The cooling capacity of the coolant cooler is strongly dependent on operating conditions of the drive device and environmental conditions in an environment of the drive device. For example, the cooling capacity is dependent on a coolant temperature of the coolant in the coolant cooler, and on an environmental temperature. The cooling air mass flow flowing in each case through the coolant coolers additionally influences the cooling capacity.

Particularly in the case of a different embodiment and/or a different arrangement of the coolant coolers, different cooling capacities of the coolant coolers may thus result for different operating conditions and/or environmental conditions, namely such that the coolant can be better cooled with one of the coolant coolers than with the other one of the coolant coolers. In this instance, the portion of the coolant supplied to the first mentioned coolant cooler should be increased, and the portion of the coolant supplied to the other one of the coolant coolers should be reduced. This is implemented such that the total cooling capacity of the two coolant coolers is at a maximum, namely for the given operating conditions and/or environmental conditions. Different first portions and different second portions may thus result for different operating conditions and/or environmental conditions.

The invention provides that the coolant be divided between the first coolant cooler and the second coolant cooler as a function of a driving speed of the motor vehicle and/or of a blower control and/or of a cooling air mass flow and/or of a coolant volumetric flow of the motor vehicle. The driving speed represents an operating condition of the motor vehicle or of the drive device. It influences the cooling air flow which flows on or through the first coolant cooler and the second coolant cooler. Given a different embodiment and/or arrangement of the coolant cooler, different cooling capacities of the coolant coolers may obtain at a given driving speed of the motor vehicle.

In other words, the cooling capacities of the two coolant coolers can be formulated as a function of the driving speed of the motor vehicle. For different driving speeds of the motor vehicle, in particular for all driving speeds of the motor vehicle that occur under normal operating conditions, first portions and second portions of the coolant should now be determined for which the total cooling capacity at the respective driving speed is as high as possible, in particular is at a maximum.

Alternatively or additionally, it is provided that the coolant be divided between the first coolant cooler and the second coolant cooler as a function of a blower control and/or of the cooling air mass flow and/or of the coolant volumetric flow of the motor vehicle. These in each case represent an operating condition of the motor vehicle or of the drive device. It influences the cooling air flow which flows on or through the first coolant cooler and the second coolant cooler. Given a different embodiment and/or arrangement of the coolant coolers, different cooling capacities of the coolant coolers may obtain for a given blower control and/or for a given cooling air mass flow and/or for a given coolant volumetric flow of the motor vehicle. In other words, the cooling capacities of both coolant coolers can be formulated as a function of the blower control and/or of the cooling air mass flow and/or of the coolant volumetric flow of the motor vehicle.

For different blower activations and/or cooling air mass flows and/or coolant volumetric flows of the motor vehicle, in particular for all fan activations and/or cooling air mass flows and/or coolant volumetric flows of the motor vehicle that occur under normal operating conditions, first portions and second portions of the coolant should now be determined for which the total cooling capacity is as high as possible, in particular is at a maximum, given the blower control in question and/or given the cooling air mass flow in question and/or given the coolant volumetric flow in question.

A further embodiment of the invention provides that a manipulated variable for the control mechanism be determined by means of a mathematical relationship, a characteristic map, and/or a closed-loop controller. The manipulated variable is set at the final control element and determines how the coolant is divided between the coolant coolers. Both the first portion and the second portion in this respect directly depend on the manipulated variable. For example, one of the portions increases as the manipulated variable increases, in contrast to which another of the portions decreases as the manipulated variable increases. The manipulated variable may be determined using the mathematical relationship, the characteristic map, or the closed-loop controller. The environmental conditions and/or operating conditions here represent at least one input variable, in contrast to which the manipulated variable is present as an output variable.

A further preferred embodiment of the invention provides that the coolant be divided between the first coolant cooler and the second coolant cooler at a first junction of the cooling circuit, and be reunited at a second junction downstream of the first coolant cooler and the second coolant cooler. The heat-generating device, or its heat exchanger, is fluidically connected to the first junction and the second junction.

Between the first junction and the second junction, the two coolant coolers are present parallel to one another in terms of flow. At the first junction situated upstream of the coolant cooler, the coolant is divided between the two coolant coolers. The coolant streams are reunited at the second junction downstream of the two coolant coolers. A comparatively simple circuit is therefore realized in terms of flow, but one which nevertheless enables a cooling of the heat-generating device in a particularly effective manner.

A development of the invention provides that a temperature difference of the coolant between the first junction and the second junction be used as a controlled variable for the closed-loop controller. The coolant has a first temperature at the first junction and a second temperature at the second junction. The second temperature here corresponds to the temperature of the portions of the coolant flowing through the coolant cooler, averaged across the mass flow. The second temperature of the coolant is determined fluidically after the coolant streams are reunited downstream of the coolant coolers. The temperature difference is the difference between the first temperature and the second temperature. This temperature difference is now used as an input variable for the closed-loop controller, consequently therefore as a controlled variable. By using the closed-loop controller to determine the manipulated variable on the basis of the temperature difference, the coolant is optimally divided betweenst the coolant coolers in accordance with the current environmental conditions and/or operating conditions.

A further preferred embodiment of the invention provides that at least one control valve or at least one flow control valve be used as a final control element. The control valve is present as a 3/2-way valve, for example. It is particularly preferably designed as a continuously adjustable valve, in other words, for example as a 3/2-way continuously adjustable valve. The use of the control valve has the advantage that a particularly precise division of the coolant between the coolant coolers is possible. Alternatively, the at least one flow control valve may be used as a final control element. The flow control valve is fluidically upstream or downstream of one of the coolant coolers and is here arranged parallel to the other coolant cooler. By adjusting a flow cross-sectional area of the flow control valve, the portion of the coolant which flows through the corresponding coolant cooler may be determined. The flow control valve represents a particularly simple and cost-effective way of dividing the coolant between the coolant coolers.

Finally, within the scope of a further preferred embodiment of the invention, it may be provided that a coolant cooler that has a higher rated cooling capacity than the second coolant cooler be used as the first coolant cooler. For example, the first coolant cooler is present as a main cooler and the second coolant cooler is present as an auxiliary cooler. Accordingly, the rated cooling capacity, in other words, the maximum and permanently possible cooling capacity given typical operating conditions, is greater for the first coolant cooler than for the second coolant cooler so that—depending on the operating conditions and/or the environmental conditions—the coolant can be cooled more strongly by means of the first coolant cooler than with the second coolant cooler.

Such an embodiment has the advantage that a further operating range of the drive device may be covered solely by means of the first coolant cooler, in contrast to which the second coolant cooler is additionally used to cool the coolant only in certain operating states, for example during high-speed driving of the motor vehicle and/or with high environmental temperatures. The second coolant cooler may in this respect be structurally designed to be markedly smaller than the first coolant cooler, in particular it may have a lower rated cooling capacity.

The invention furthermore relates to a drive device of a motor vehicle, in particular to the implementation of the method according to the preceding embodiments, wherein the drive device has at least one heat-generating device and a cooling circuit for cooling the heat-generating device, and at least one first coolant cooler of the cooling circuit and at least one second coolant cooler of the cooling circuit are fluidically connected in parallel to the heat-generating device, wherein the drive device is designed to divide coolant arriving from the heat-generating device between the first coolant cooler and the second coolant cooler by means of a final control element. It is thereby provided that the coolant be divided between the first coolant cooler and the second coolant cooler as a function of a driving speed and/or of a blower control and/or of a cooling air mass flow and/or of a coolant volumetric flow of the motor vehicle.

The advantages of such a design of the drive device or such an approach have already been pointed out. Both the drive device and the method for its operation may be further developed in accordance with the preceding explanations, such that these are referenced in this respect.

The invention is explained in more detail below with reference to the exemplary embodiments shown in the drawing, without any limitation of the invention ensuing. Shown are:

FIG. 1 a schematic of a region of a drive device of a motor vehicle, and

Figure 2:
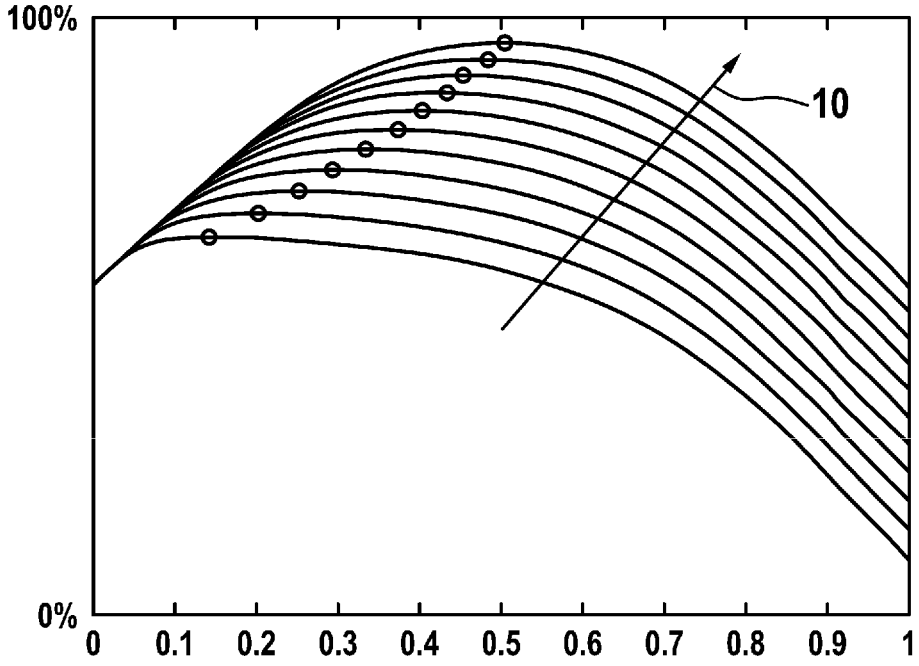

FIG. 2 a diagram in which a total cooling capacity of two coolant coolers is plotted against a apportionment factor of coolant to the two coolant coolers.

FIG. 1 shows a schematic of a region of a drive device 1 of a motor vehicle (not shown in detail). Of the drive device 1, a heat-generating device 2 is depicted which is preferably present in the form of a drive unit. The drive unit is, for example, designed as an internal combustion engine or as an electric motor. For cooling the device 2, a cooling circuit 3 is provided by means of which coolant may be supplied to the device 2. Insofar as it is discussed within the scope of this description that coolant is supplied to the device 2, such an embodiment may actually be realized or—alternatively—a heat exchanger may be associated with the device 2, to which heat exchanger the coolant is ultimately supplied. In this case, the heat exchanger is connected with the device 2 so as to transfer heat, so that the device 2 may be cooled by means of the coolant supplied to the heat exchanger.

In addition to the device 2, at least one first coolant cooler 4 and at least one second coolant cooler 5, in the exemplary embodiment depicted here two second coolant coolers 5, are realized in the cooling circuit 3. The first coolant cooler 4 is designed as a main cooler, in contrast to which the second coolant coolers 5 are present as auxiliary coolers or secondary coolers. According to the arrows 6, the coolant coolers 4 and 5 may be charged with cooling air which preferably passes through the coolant coolers 4 and 5. The cooling air flows indicated by the arrows 6 are preferably induced by a blower of the drive device 1 and/or by a movement of the motor vehicle.

The two coolant coolers 4 and 5 are fluidically connected in parallel to the device 2. The coolant arriving from the device 2 is hereby divided at a first junction 7 between the two coolant coolers 4 and 5 and reunited at a second junction 8. The first coolant cooler 4 is hereby fluidically connected to the first junction 7 on one side and to the second junction 8 on the other side. By contrast, the second coolant coolers 5 are connected in series with each other between the junctions 7 and 8. In other words, the second coolant coolers 5 are both present in parallel with the first coolant cooler 4. It is apparent that the second coolant coolers 5 are markedly smaller or more compact in design than the first coolant cooler 4. Accordingly, they have a lower rated cooling capacity than the first coolant cooler 4. In particular, their joint rated cooling capacity is less than or equal to the rated cooling capacity of the first coolant cooler 4.

The drive device 1, or the cooling circuit 3, is designed such that the coolant arriving from the heat-generating device 2 may be specifically divided betweenst the first coolant cooler 4 and the second coolant coolers 5. For this purpose, a final control element 9 is provided which, in the exemplary embodiment shown here, is present in the form of a control valve. The control valve is hereby preferably designed as a 3/2-way valve, in particular as a 3/2-way continuously adjustable valve, so that the coolant can be distributed in any desired proportions amongst the coolant coolers 4 and 5.

The coolant flowing through the first coolant cooler 4 is cooled with a first cooling capacity, and the coolant flowing through the second coolant cooler 5 is cooled with a second cooling capacity. A total cooling capacity of the coolant coolers 4 and 5 results from the first cooling capacity and the second cooling capacity. It is now provided that the coolant be divided between the coolant coolers 4 and 5 by means of the final control element 9 such that a greatest possible total cooling capacity results. For example, for this purpose the final control element 9 is set to divide the coolant between the coolant coolers 4 and 5 as a function of a driving speed of the motor vehicle. It is alternatively or additionally possible to set the final control element 9 to divide the coolant between the coolant coolers 4 and 5 as a function of a blower control and/or of a cooling air mass flow and/or of a coolant volumetric flow.

A manipulated variable for the final control element 9 is here determined by means of a mathematical relationship, a characteristic map, or a closed-loop controller, for example. In the case of the closed-loop controller, the manipulated variable represents an output variable, in contrast to which a controlled variable forms an input variable. For example, a temperature difference is used as controlled variable, in particular a temperature difference between a temperature of the coolant at the first junction 7 and a temperature of the coolant at the second junction 8. The control objective is to maximize the temperature difference so that a greatest possible total cooling capacity of the coolant coolers 4 and 5 is accordingly realized.

FIG. 2 shows a characteristic map in which a total cooling capacity in percent, relative to a maximum cooling capacity, is plotted against an apportionment factor. The different curves result for a cooling air mass flow through the coolants 4 and 5 which increases in the direction of the arrow 10. The apportionment factor indicates the proportion of the coolant which is supplied to the second coolant coolers 5. Given an apportionment factor of 0, the entirety of the coolant is thus supplied to the first coolant cooler 4, in contrast to which no coolant flows through the second coolant cooler 5. Given an apportionment factor of 1, the reverse applies, such that in this instance the entirety of the coolant flows through the second coolant cooler 5. Given an apportionment factor of 0.5, there is a uniform apportionment of the coolant between the coolant coolers 4 and 5.

For each of the curves, the respective maximum of the total cooling capacity is indicated by a circle. It has been shown that the maximum of the total cooling capacity for increasing apportionment factors is present with increasing cooling air mass flow, for example caused by an increasing driving speed of the motor vehicle. Accordingly, the final control element 9 is set in such a way that this maximum of the total cooling capacity is achieved.

With the described embodiment of the drive device 1, or of the corresponding procedure during its operation, the device 2 may be cooled particularly effectively and efficiently. In particular, an optimal total cooling capacity of the coolant coolers 4 and 5 is realized in each case for different operating conditions and/or different environmental conditions.

The invention claimed is:

1. A method, comprising:

operating a drive device of a motor vehicle, wherein the drive device has at least one heat-generating device as well as a cooling circuit for cooling the heat-generating device, and at least one first coolant cooler of the cooling circuit and at least one second coolant cooler of the cooling circuit are connected in parallel with each other; and dividing coolant arriving from the heat-generating device by a final control element between the first coolant cooler and the second coolant cooler, wherein the coolant is divided between the first coolant cooler and the second coolant cooler as a function of a parameter selected from the group consisting of: a driving speed, a blower control, a cooling air mass flow, and a coolant volumetric flow of the motor vehicle.

2. The method according to claim 1, wherein the coolant is cooled by the first coolant cooler with a first cooling capacity and by the second coolant cooler with a second cooling capacity.

3. The method according to claim 2, wherein the coolant is divided between the first coolant cooler and the second coolant cooler such that a total cooling capacity resulting from the first cooling capacity and the second cooling capacity is at a maximum.

4. The method according to claim 1, wherein a manipulated variable for the final control element is determined using a technique selected from the group consisting of: a mathematical relationship, a characteristic map, and a closed-loop controller.

5. The method according to claim 1, wherein the coolant is divided between the first coolant cooler and the second coolant cooler at a first junction of the cooling circuit, and is merged at a second junction downstream of the first coolant cooler and the second coolant cooler.

6. The method according to claim 5, wherein a temperature difference of the coolant between the first junction and the second junction is used as a controlled variable for the final control element.

7. The method according to claim 1, wherein at least one control valve or at least one flow control valve is used as the final control element.

8. The method according to claim 1, wherein the at least one first coolant cooler has a higher rated cooling capacity than the at least one second coolant cooler.

9. A drive device of a motor vehicle, comprising:

at least one heat-generating device as well as a cooling circuit for cooling the heat-generating device, at least one first coolant cooler of the cooling circuit and at least one second coolant cooler of the cooling circuit connected in parallel with each other;

wherein the drive device is designed to divide coolant arriving from the heat-generating device between the first coolant cooler and the second coolant cooler by a final control element, wherein the coolant is divided between the first coolant cooler and the second coolant cooler as a function of a parameter selected from the group consisting of: a driving speed, a blower control, a cooling air mass flow, and a coolant volumetric flow of the motor vehicle.

10. The drive device according to claim 9 wherein the first coolant cooler has a first cooling capacity and the second coolant cooler has a second cooling capacity that is greater than the first cooling capacity.

11. The drive device according to claim 9, further comprising a first junction where the coolant is divided between the first coolant cooler and the second coolant cooler and a second junction where the coolant is merged from the first coolant cooler and the second coolant cooler.

12. The drive device according to claim 9 wherein the final control element includes a flow control valve.

13. A method, comprising:

operating a motor vehicle having a heat-generating device;

circulating a coolant through a cooling circuit to carry heat away from the heat-generating device;

dividing the coolant carrying the heat away from the heat-generating device between a first coolant cooler having a first cooling capacity and a second coolant cooler having a second cooling capacity greater than the first cooling capacity based on a parameter of the operation of the motor vehicle to maximize the combined cooling capacity of the first coolant cooler and the second coolant cooler.

14. The method according to claim 13, wherein the dividing the coolant carrying the heat away from the heat-generating device between the first coolant cooler and the second coolant cooler is based on a difference between a first temperature of the coolant before being cooled by the first coolant cooler and the second coolant coolers and a second temperature of the coolant after being cooled by the first coolant cooler and the second coolant cooler.

15. The method of claim 1, wherein a third coolant cooler of the cooling circuit and the first coolant cooler are connected in series with each other.

16. The method of claim 15 wherein the first and third coolant coolers have a combined first cooling capacity and the second coolant cooler has a second cooling capacity greater than the first cooling capacity.

17. The drive device of claim 9 wherein a third coolant cooler of the cooling circuit and the first coolant cooler are connected in series with each other.

18. The drive device of claim 17 wherein the first and third coolant coolers have a combined first cooling capacity and the second coolant cooler has a second cooling capacity greater than the first cooling capacity.

19. The method of claim 13, wherein a third coolant cooler of the cooling circuit and the first coolant cooler are connected in series with each other.

* * * * *